United States Patent [19]

Chase

[11] Patent Number: 4,678,149

[45] Date of Patent: Jul. 7, 1987

[54] SUPPORT

[76] Inventor: Geoffrey S. Chase, 17 High Street, Criccieth, Gwynedd LL52 OBS, England

[21] Appl. No.: 774,536

[22] Filed: Sep. 10, 1985

[30] Foreign Application Priority Data

Sep. 21, 1984 [GB] United Kingdom ..... 8423951

[51] Int. Cl.[4] ..... A47G 23/02

[52] U.S. Cl. ..... 248/150; 248/152; 248/165; 248/174; 248/311.3; D7/70; D9/369; D9/455

[58] Field of Search ..... 248/152, 150, 145.3, 248/174, 311.3, 523, 165, 94; 211/70.1, 72, 73, 74, 79, 85; D9/455, 369; D7/70

[56] References Cited

U.S. PATENT DOCUMENTS

| | | | |
|---|---|---|---|
| D. 249,317 | 9/1978 | Kurn | D7/70 |
| 511,976 | 1/1894 | Thompson | 248/174 |
| 732,936 | 7/1903 | Graeme | 248/152 X |
| 901,326 | 10/1908 | Ebert | 248/152 X |
| 1,754,766 | 4/1930 | Phillips | 248/165 |
| 2,767,744 | 10/1956 | Beerman | D7/70 |
| 3,239,177 | 3/1966 | Samsing | 248/152 X |
| 3,970,278 | 7/1976 | Studer | 248/165 X |
| 4,271,878 | 6/1981 | Buloga | 211/74 X |

*Primary Examiner*—Robert W. Gibson, Jr.
*Assistant Examiner*—David L. Talbott
*Attorney, Agent, or Firm*—Young & Thompson

[57] ABSTRACT

A support is constructed from a single, flat blank, e.g. of a resilient plastics material, which comprises an array of spaced, parallel tongues joined at their roots by a web and a base portion which is integral with the free end of one of the tongues and bendable relative thereto to a position where tabs on the remaining tongues can be passed through arcuate slots in the base. The tongues splay from the web so that some diverge downwardly while the rest converge downwardly to provide a cage-like enclosure adapted to hole a container for viscous material, such as a sauce bottle, in an inverted position. A projection on one end of the web engages a lug on its other end to hold the web in the shape of a ring, and the tabs lock in their associated slots by resuming a flat condition after being bent to pass through the arcuate slots.

9 Claims, 5 Drawing Figures

SUPPORT

BACKGROUND OF THE INVENTION

This invention relates to a support, and more particularly to a stand or support which can be self-assembled from one or more originally flat components without the use of extraneous fastening devices. Such a stand or support will, prior to assembly, occupy a minimum of space for storage or transport. One of the envisaged uses of the stand or support is to hold in an inverted position relatively small containers of viscous material as found in the home or office, such as sauce bottles or containers for glue, shampoo, cosmetics, etc. Suitably dimensioned for such domestic use the stand or support of the invention is well-suited to transmission, e.g. by mail, with a minimum of packaging and danger of damage in transit.

Viscous materials in common use in the home or office, such as thick sauces, shampoo and other edible or cosmetic substances, glue and paste, are usually supplied in bottles or bottle-like containers or dispensers which have a restricted opening at the top, usually sealed by a screw-threaded or otherwise removable or openable cap. This means that the container is not free-standing, or cannot safely be stood, in an up-ended condition. Most such containers have a cylindrical body portion, perhaps tapering toward the top opening, and so the only practicable way to stand them, e.g. on a table or shelf, is on the flattened base.

This means, however, that as the contents are removed each successive pouring operation becomes more difficult and time-consuming. Viscous liquid which has had time to settle to the bottom of a bottle takes a long time to pour back to the opening along the length of the bottle when up-ended. The user must hold the bottle upside down for progressively longer periods before contents begin to emerge, perhaps encouraging the process by hitting or shaking the bottle.

A major producer of a successful sauce has recognised this problem to the extent of turning it into an advertising joke in which it is pretended that the measures needed to encourage the emergence of the sauce from the bottle (i.e. smacking it with the palm of one hand while holding it in the other) are applause for the product!

In practice, however, the problem causes considerable waste. Not everyone has the patience and ingenuity needed to extract the last of the contents and many bottles and containers are thrown away while still partially filled. The problem is exacerbated by the difficulty of seeing whether any worthwhile quantity in fact remains. Not all containers are transparent, for example shampoo is commonly sold in translucent plastics bottles, and even a transparent bottle will be obscured (a) by advertising labels and (b) by the residue which inevitably adheres to the interior of the bottle. Therefore even the most patient and most frugal user will tend to throw away a bottle which still contains a useful amount of the viscous liquid.

Another problem is that residue around the opening hardens by exposure to air and not only makes the container unpleasant to handle but tends to seal a screw top, making it difficult to unscrew. A particular problem with glue or paste dispensers is that hardened glue or paste tends to seal the opening, which has to be cleared, e.g. with a knife, before glue or paste can be dispensed. Some such dispensers have foam material in the opening serving as an application pad. If paste or glue filling the cells of the foam is allowed to harden the dispenser becomes practically unusable. However, if the opening, such as a slit, or the foam pad is continuously wetted by the paste or glue by storing the dispenser or container upside down, the danger of obstruction by hardened contents is considerably reduced if not eliminated.

The present invention proceeds from the realisation that if it were practical and convenient to store such containers in an inverted condition the contents would have time to collect and would remain adjacent the outlet until the last drop is extracted, and furthermore the outlet region would be permanently wetted, until the contents were exhausted, avoiding the problems referred to.

One object of the invention is therefore to provide a stand or support adapted to maintain a container for viscous material in an inverted condition. Another object of the invention is to provide such a stand or support which, while cheap and simple to manufacture, will provide an aesthetically appealing object which will be acceptable in kitchens, bathrooms and dining rooms. Yet another object of the invention is to provide a support which is adapted for storage and sale in a kit form consisting of one or more flat components occupying a minmum of space and not susceptible to damage but which is readily self-assembled by the purchaser into an attractive item without the use of extraneous fastening means or tools.

BRIEF SUMMARY OF THE INVENTION

In accordance with one aspect of the invention there is provided a stand or support comprising a base and an open-topped wall, wherein the wall comprises a plurality of tongues joined at their roots by a common web portion, web being bendable to make a cage-like enclosure of the tongues and the base being formed with slots to receive respective free end portions of the tongues so that the cage-like enclosure is upstanding from the base.

Means is preferably provided to connect together opposite ends of the web when bent into an annular configuration.

At least some of the tongues preferably have notches in their side edges near to their free ends, the notches engaging the corresponding slots so that free end portions of the tongues provide feet for the stand or support beneath the base. Each of said at least some tongues is preferably formed with a waist spaced from the free end of the tongue and adapted to locate in the corresponding base slot.

Each of said at least some tongues is preferably flat and resiliently bendable and each corresponding base slot is preferably curved, the arrangement being such that after bending the tongue to insert it in the corresponding base slot the tongue will, by tending to resume the flat condition, lock the associated slot in the notch on opposite sides of the waist.

The base may be integral with the free end of one of the tongues, being bendable relative thereto to a position in which the free ends of the other tongues can be inserted in the respective slots. In this case the wall and base are preferably constructed from a single, originally flat blank which has a line of weakness between the wall and base to provide a hinge about which they can be relatively bent out of the plane of the blank.

Preferably the wall and base are of a resilient plastics material.

Some of the slots in the base are preferably nearer to its center than the remainder of the slots such that the tongues splay downwardly from the web portion. Preferably the slots in the base are alternately nearer to and farther from the center of the base around the base so that some of said tongues converge from the web toward tha base to provide a downwardly-tapering enclosure.

Slots farther from the center of the base may be located in projections of the base and the slots nearer to the center of the base may be located adjacent recesses of the base between the projections.

In a construction in which the base is integral with one of the tongues one of the projections of the base may be integral with said one tongue, the latter having a foot portion of similar extent longitudinally of the tongue to the free end or foot portion of the other tongues.

The opposite ends of the web portion are preferably provided with releasable interengagement means, and to achieve this one end portion of the web may be formed or provided with a lug behind which a projection of the other end portion can be passed, the projection having in its upper edge a recess in which to receive the lug.

In accordance with another aspect of the present invention there is provided a stand for domestic use for holding in an inverted position a container for viscous material, such as sauce, glue or cosmetics, the stand comprising a wall portion and a base portion, the wall portion comprising a cage-like enclosure of elongated tongues each having a root and a free end, the base portion being flat, slotted and joined at its periphery to one of the tongues in the region of the free end of the latter, free end portions of the remaining tongues being received in respective slots of the base, the tongues being commonly joined at their roots by an annular web portion at the top of the wall portion and substantially parallel with the base, the slots in the base being circumferentially distributed therearound alternately nearer to and farther from the center of the base such that some of said tongues diverge downwardly from the web and other of said tongues, each between an adjacent divergent pair of tongues, converge downwardly from the web.

In accordance with yet another aspect of the present invention there is provided a unitary, flat blank of resiliently bendable sheet material from which a stand can be constructed without the aid of tools or extraneous fastening devices, the blank comprising a wall portion and a base portion, the wall portion comprising a plurality of mutually-spaced, generally parallel tongues and a web portion transverse of the tongues and joining the latter at their roots, and the base portion being joined at its periphery to an intermediate one of said tongues near to the free end of the latter over a line of weakness transverse of said intermediate tongue and each of the remaining said tongues being formed near the free end thereof with a waist, the waists and said line of weakness being disposed generally on the same line transverse of the tongues and parallel with the web portion, the base portion being formed with arcuate slots concave toward the center of the base and circumferentially spaced therearound alternately nearer to and farther from said center and means being provided on the web portion releasably to join together its opposite ends, the arrangement being such that when the web is bent into a ring-like form to allow its opposite ends to be joined together the free end of each said remaining tongue may be bent about lines longitudinal of the tongue to insert it through a corresponding one of said slots and when released, with the waist of said tongue in the slot, will releasably lock the base relative to said tongue, the disposition of the slots being such that in combination with the base the tongues will form a cage-like enclosure, alternate tongues around the base converging or diverging from the web toward the base.

BRIEF DESCRIPTION OF THE DRAWINGS

By way of non-limitative example an embodiment of the present invention is ilustrated in the accompanying diagrammatic drawings. In the drawings.

DETAILED DESCRIPTION OF A PREFERRED EMBODIMENT

Figure 1:
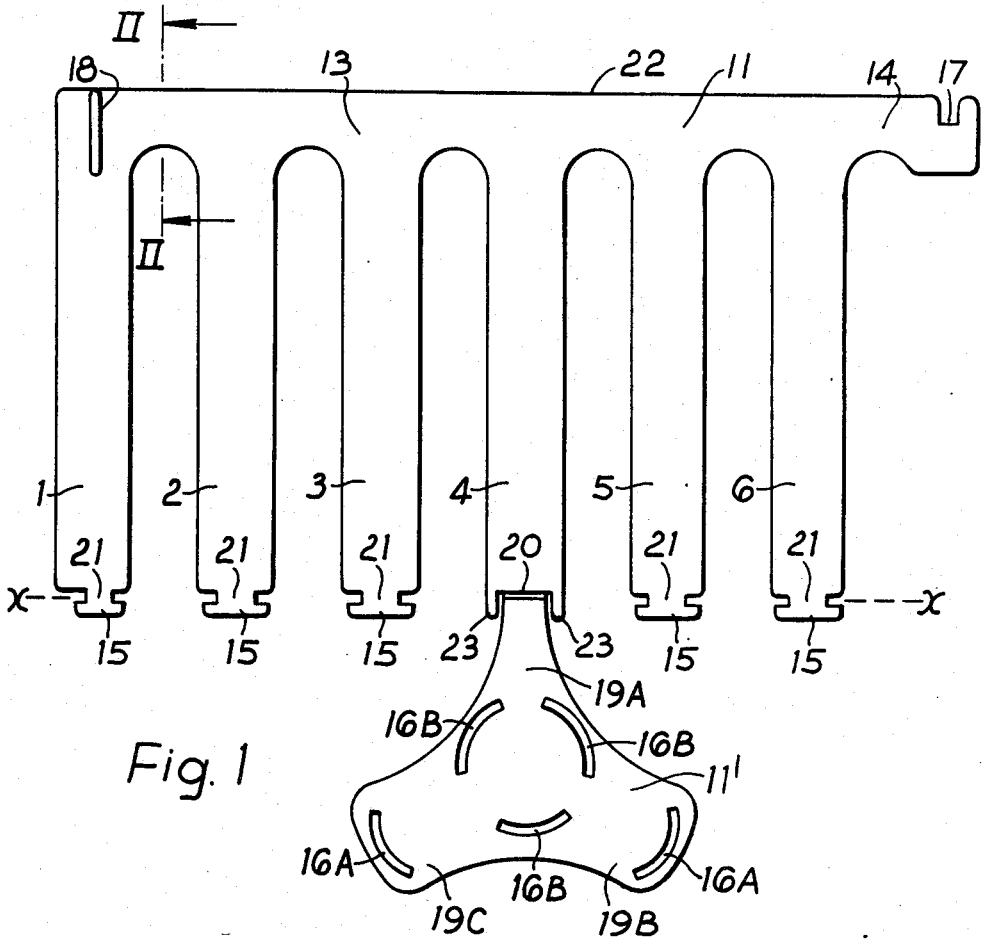
FIG. 1 illustrates a flat blank from which the stand or support of FIGS. 3-5 can be assembled.
Figure 2:
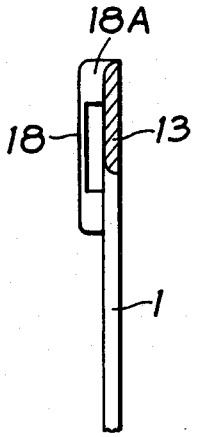
FIG. 2 is a detail on an enlarged scale taken on the line II—II of FIG. 1.
Figure 3:
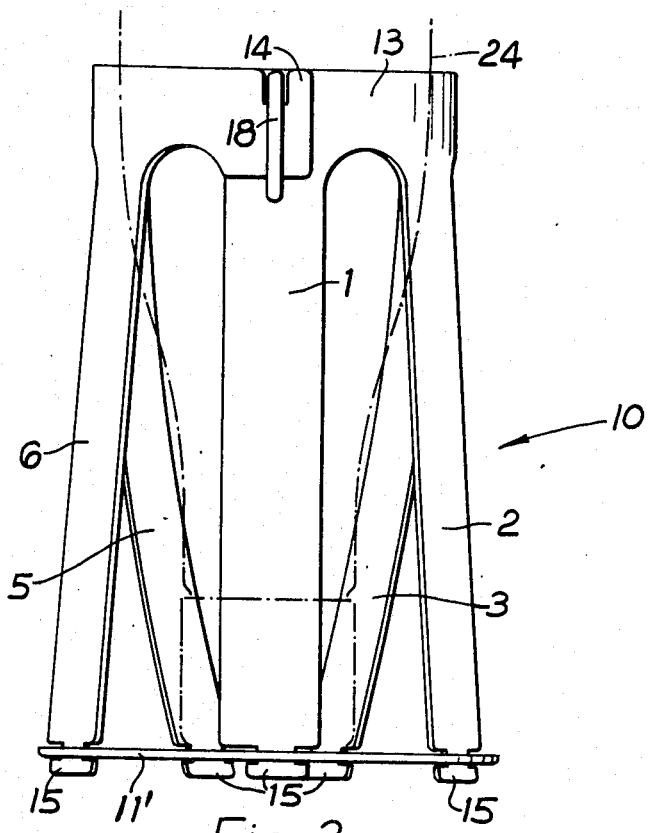
FIG. 3 is a side elevation of a stand or support assembled from the blank of FIGS. 1 and 2, and FIGS. 4 and 5 are, respectively, a plan view and an underplan view of the assembled stand or support of FIG. 3.
Figure 4:
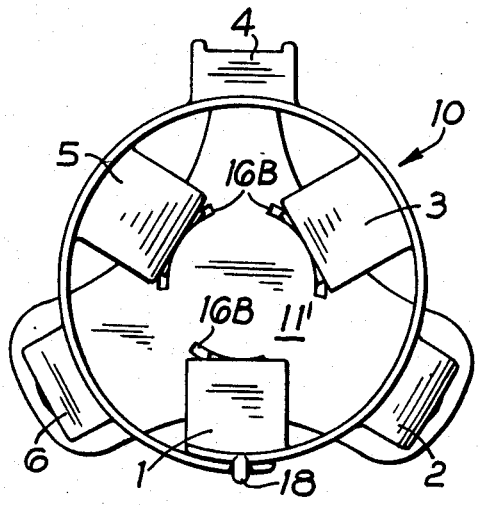
Figure 5:
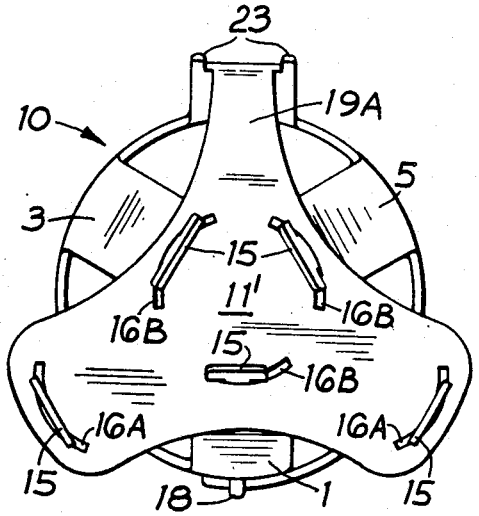

The stand or support 10 illustrated in a completed condition in FIGS. 3-5 is constructed from the flat blank 11 shown in FIGS. 1 and 2. The blank 11 is of a resilient and preferably washable material, such as a suitable plastics material, which is shaped to comprise spaced, parallel tongues numbered 1-6 joined along their top edges or roots by a web portion 13 of the blank. This is formed at one end with a projection 14 having a recess 17 in the upper edge for a purpose to be described, and at the opposite end of the web portion 13 is a loop-shaped lug 18 better seen in FIG. 2.

Integral with the free end of the tongue 4 is a base portion 11' of the blank. This is of approximately trefoil configuration, comprising three projections 19A, 19B, 19C, one of which, 19A, joins the tongue 4 over a groove 20, the latter providing a line of weakness about which the base 11' can be bent out of the plane of the remainder of the blank 11. In each of the projections 19B and 19C is a curved slot 16A and near to the center of each curved recess between the projections 19A, 19B, 19C, is a respective curved slot 16B, lying nearer to the center of the base 11' than the slots 16A. The inner slots 16B lie on a circle having the same center as the base 11' in an angularly offset relation to the outer slots 16A.

At the free end of each tongue 1-3, 5 and 6 is a respective tab 15. These tabs are formed by notching opposite sides of each tongue 1-3, 5 and 6 to provide a waist 21 lying approximately on the same line x—x parallel with the top edge 22 of the blank 11 as the groove 20. It will be noted that the free end of the tongue 4 is formed with projections 23 on opposite sides of the projection 19A of the base. When the base 11' is bent about the groove 20 the projections 23 remain in the plane of the tongue 4, so that the tongue 4 inclusive of its projections 23 is of substantially equal length to the remaining tongues 1 to 3, 5 and 6 inclusive of their tabs 15. However, the tongues 1, 3 and 5 may have slightly shorter tabs 15, or put another way the waists 21 of the tabs of the tongues 1, 3 and 5 may be nearer to the free ends of said tongues than in the case of the tongues 2 and 6, e.g. by a factor of about 1 mm, for a reason to be described.

The blank 11 can be stored and can be despatched to the customer in the flat or unassembled condition of FIG. 1, being more convenient to pack and less susceptible to damage than when in the assembled state shown in FIGS. 3–5. Alternatively, for transport or storage the assembly of FIGS. 3–5 can be reverted to the flat state of FIG. 1.

To assemble the stand or support 10 from the blank 11 the tabs 15 are inserted in sequence into the slots 16B and 16A starting with the slots 16B nearer to the projection 19A of the base 11′ and working round the base 11′ until the projection 14 of the web 13 is in overlapping relation with the opposite end of the web. The projection 14 is inserted into the lug 18 like a gate latch in its keeper and then pulled up so that the top 18A of the lug is received in the recess 17. The whole of the curved upper edge 22 of the blank now lies in the same plane and the opposite ends of the web 13 are releasably joined. The flexibility of the tongues 1–6 allows every alternate tongue 3, 5 and 1 to be taken to a respective one of the inner ring of slots 16B so that in the assembled state, as shown in FIGS. 3–5, the web 13 is curled into a ring and the tongues 1–6 form a cage-like enclosure upstanding from the base 11′. The slots 16A and 16B are in a staggered relationship circumferentially of the base and the tongues 2 and 6 which engage by their tabs 15 the outer slots 16A diverge downwardly from the web 11 similarly to the tongue 4 to form an outer cage, whereas the remaining tongues 1, 3 and 5 extend from the ring 13 to the inner part of the base 11′ in the form of an inner enclosure generally of inverted cone shape, i.e. alternate tongues splay oppositely from the web 13 to provide a downwardly diverging and a downwardly converging array. The stand or support is finished by interengaging the projection 14 with its lug 18 as described so that opposite ends of the web 13 overlap to present a generally continuous ring.

Apart from contributing to an attractive and interesting appearance the outwardly splayed tongues 2, 4 and 6, strengthen the self-supporting finished structure while the inwardly splayed or convergent tongues 1, 3 and 5 are shaped and dimensioned to hold in an inverted position the tapered, upper end portion or neck of a conventional sauce bottle 24 when it is inserted, screw-cap first, through the ring 13 from above, as shown in broken lines in FIG. 3. The tabs 15 projecting below the base 11′ serve jointly with the projections 23 as feet on which the stand or support 10 can rest on a table or shelf.

Each of the tabs 15 will have to be bent about lines longitudinal of the associated tongue in order to pass it through the corresponding slot 16. As soon as it is released, by springing back to the flat condition, the waist 21 will be releasably locked in the slot 16 by the notches overlapping the slot. This prevents unintentional disengagement of a tongue 1–3, 5 or 6 from the base 11′. To dismantle the stand or support and return it to the flat state each tab 15 must be deliberately bent again to disengage it from its slot 16.

To achieve the objects of the invention it is not necessary that the bottle should conform exactly to the shape of the convergent tongues 1, 3 and 5 and a tight fit would be undesirable, but to adapt the stand or support 10 to receive bottles of substantially different diameter means (not shown) may be provided for varying at will the diameter of the ring formed by the web portion 13 by enabling its overlapping ends to be joined at different positions—for example the projection 14 may have more than one recess 17 in its upper edge or a stud (not shown) on one end of the web 13 might be insertable into a chosen one of a series of holes (not shown) on the other end. Similarly the base 11′ may have a shape different from that shown, e.g. it may be circular, and the inner slots 16B may be located on a circle of greater diameter so as to reduce or even eliminate the convergence of the tongues 1, 3 and 5. A construction in which all the tongues, or inner ones, lie approximately on a cylinder will be suitable for supporting an inverted container which lacks a tapering neck, e.g. a mayonnaise bottle.

As above mentioned, the inner or convergent tongues 1, 3 and 5 may have slightly shallower tabs 15 than the outer or divergent ones. The effect will be that while unloaded the support will stand on a flat surface on the projections 23 and the tabs of the tongues 2 and 6 only, the tabs of the tongues 1, 3 and 5 being suspended slightly above it. If a container heavy enough to deflect the base 11′ is now inserted so that it bears on the central area of the base it will press down the tabs 15 of the tongues 1, 3 and 5 until they contact the supporting surface. Were it not for this arrangement there is a danger that the deflection of the base 11′ might raise one or more of the tabs of the tongues 2 and 6 and the projections 23 off the supporting surface, making the support relatively less stable.

What is claimed is:

1. A support comprising a slotted base portion and an originally flat, open-topped wall portion, the wall portion comprising a web and a plurality of tongues, each tongue having a root and a free end, the tongues being commonly joined at their roots by said web, the web being bendable to make a cage-like enclosure of the tongues, means to connect together opposite ends of the web when the web is bent into an annular configuration to make said enclosure, the base slots being arranged to receive respective free end portions of at least some of the tongues so that the cage-like enclosure is upstanding from the base and each said at least some tongues having a formation spaced from the free end thereof to engage the associated slot whereby said free end portions provide feet for the support beneath the base.

2. A support as claimed in claim 1, wherein each said formation comprises notch means adapted to engage the corresponding slot.

3. A support as claimed in claim 2 wherein each said formation comprises a waist spaced from the free end of the associated tongue, the waist being adapted to locate in the corresponding base slot and defining a pair of notches in opposite side edges of said tongue.

4. A support comprising a slotted base portion and an open-topped wall portion, the wall portion comprising a web and a plurality of tongues, each tongue having a root and a free end, the tongues being commonly joined at their roots by said web, the web being bendable to make a cage-like enclosure of the tongues and the base slots being arranged to receive respective free end portions of the tongues so that the cage-like enclosure is upstanding from the base, at least some of the tongues having notches in their side edges near to their free ends to define a waist of each said at least some tongues spaced from the free end of the tongue and adapted to locate in the corresponding base slot so that free end portions of the tongues provide feet for the support beneath the base, each of said at least some tongues being flat and resiliently bendable and each corresponding base slot being curved, the arrangement being such that after bending the tongue to insert it in the corresponding base slot the tongue will, be tending to resume the flat condition, lock the associated slot in the waist.

5. A support as claimed in claim 4, wherein the base is integral with the free end of one of the tongues, being bendable relative thereto to a position in which the free ends of the other tongues can be inserted in the respective slots.

6. A support as claimed in claim 5, wherein the wall portion and base portion are constructed from a single, originally flat blank, the blank having a line of weakness between the wall and base portion to provide a hinge about which they can be relatively bent out of the plane of the blank.

7. A support as claimed in claim 4, wherein some of the slots in the base are nearer to its center than the remainder of the slots such that the tongues splay downwardly from the web portion.

8. A stand for domestic use in holding in an inverted position a container for viscous material, such as sauce, glue or cosmetics, the stand comprising a wall portion and a base portion, the wall portion comprising a cage-like enclosure of elongated tongues each having a root and a free end, the base portion being flat, slotted and joined at its periphery to one of the tongues in the region of the free end of the latter, free end portions of the remaining tongues being received in respective slots of the base, the tongues being commonly joined at their roots by an annular web portion at the top of the wall portion and substantially parallel with the base, the slots in the base being circumferentially distributed therearound alternately nearer to and farther from the center of the base such that some of said tongues diverge downwardly from the web and other of said tongues, each between an adjacent divergent pair of tongues, coverge downwardly from the web.

9. A unitary, flat blank of resiliently bendable sheet material from which a stand can be constructed without the aid of tools or extraneous fastening devices, the blank comprising a wall portion and a base portion, the wall portion comprising a plurality of mutually spaced, generally parallel tongues and a web portion transverse of the tongues and joining the latter at their roots, and the base portion being joined at its periphery to an intermediate one of said tongues near to the free end of the latter over a line of weakness transverse of said intermediate tongue and each of the remaining said tongues being formed near the free end thereof with a waist, the waists and said line of weakness being disposed generally on the same line transverse of the tongues and parallel with the web portion, the base portion being formed with arcuate slots concave toward the center of the base and circumferentially spaced therearound alternately nearer to and farther from said center and means being provided on the web portion releasably to join together its opposite ends, the arrangement being such that when the web is bent into a ring-like form to allow its opposite ends to be joined together the free end of each said remaining tongue may be bent about lines longitudinal of the tongue to insert it through a corresponding one of said slots and when released, with the waist of said tongue in the slot, will releasably lock the base relative to said tongue, the disposition of the slots being such that in combination with the base the tongues will form a cage-like enclosure, alternate tongues around the base converging or diverging from the web toward the base.

* * * * *

UNITED STATES PATENT AND TRADEMARK OFFICE

CERTIFICATE OF CORRECTION

PATENT NO. : 4,678,149

DATED : July 7, 1987

INVENTOR(S) : Geoffrey Stephen CHASE

It is certified that error appears in the above—identified patent and that said Letters Patent is hereby corrected as shown below: On the Title Page:

In the residence of the inventor, Item 76, change "England" to -- United Kingdom --.

Signed and Sealed this

Twenty-sixth Day of January, 1988

*Attest:*

DONALD J. QUIGG

*Attesting Officer*

*Commissioner of Patents and Trademarks*